United States Patent [19]

Malone

[11] Patent Number: 4,998,682

[45] Date of Patent: Mar. 12, 1991

[54] PAPER TAPE WINDING AND INVERTING DEVICE

[76] Inventor: Stephen W. Malone, 707 Tee Cir., New Smyrna Beach, Fla. 32069

[21] Appl. No.: 412,345

[22] Filed: Sep. 26, 1989

[51] Int. Cl.[5] ..... B65H 18/04

[52] U.S. Cl. ..... 242/67.10 R

[58] Field of Search ..... 242/67.1 R, 67.3 R, 242/67.4, 99, 76; 400/594, 613, 619

[56] References Cited

U.S. PATENT DOCUMENTS

| | | | |
|---|---|---|---|
| 2,846,159 | 1/1954 | Reynolds | 242/67.1 R |
| 4,700,906 | 10/1987 | Lapadakis | 242/67.3 R |
| 4,875,634 | 10/1989 | Lapadakis | 242/67.3 R |

FOREIGN PATENT DOCUMENTS

| | | | |
|---|---|---|---|
| 627028 | 10/1961 | Italy | 242/76 |

*Primary Examiner*—Daniel P. Stodola
*Assistant Examiner*—John P. Darling
*Attorney, Agent, or Firm*—Terry M. Gernstein

[57] ABSTRACT

A device that is releasably attached to an office machine, such as an adding machine or the like, includes a disposable container and a cover as well as several angularly oriented inverting rollers. As the paper is moved from a feed roller, it passes over the inverting rollers to be gradually turned over 180° from its original orientation on the feed roller as it passes to the take-up roller. The device includes slots and guide rollers so the paper tape can be stored and viewed if necessary at a later time.

1 Claim, 3 Drawing Sheets

PAPER TAPE WINDING AND INVERTING DEVICE

TECHNICAL FIELD OF THE INVENTION

The present invention relates to the general art of office machines, and to the particular field of winding mechanisms associated with such office machines.

BACKGROUND OF THE INVENTION

Recording machines, and, in particular, adding machines are now made to carry a spool on which is wound a strip of paper. The lead end of the strip of paper is passed around a platen of the adding machine whereupon indicia or the like is imprinted on one surface of that paper. It is customary that the strip of paper is torn off after the record has been completed. These torn strips of paper have been a problem, and are often simply thrown away or are clipped to the item associated with the adding process.

Such a process of using one side of a strip of paper, and discarding such strip was found to be wasteful and uneconomical. Accordingly, the art has included mechanisms that are intended to facilitate re-use of the paper by winding the used paper in a manner that inverts the paper so a clean side is in position to be re-run through the machine.

In operation of such machines, paper tape is unwound from source roll, inprinted on one side thereof, and then re-wound onto take-up roll while having tape further drawn from the source roll. During the movement of the tape from the source roll to the take-up roll, the tape is inverted so that the tape has a clean side presented outwardly when it is wound onto the take-up roll. The rolls are then reversed, so that the take-up roll serves as the source roll, and vice versa. Examples of such devices are disclosed in U.S. Pat. Nos. 1,828,727, 4,168,038 and 4,492,345.

While effective, such devices often require the source roll to engage the take-up roll so properly timed feeding and take up are effected. This can make removing a portion of the printed tape cumbersome.

After the tape is printed on both sides, this tape is often simply placed in a drawer if it is to be saved for some reason. If, at a later time, some figure must be verified, the tape must be unwound manually. The devices such as the aforementioned devices, do not provide any convenient storage feature whereby the used tape can be stored and unwound at a latter time if necessary.

Therefore, there is a need for a device for storing the paper tape used by office machines, such as adding machines, or the like, that includes a mechanism for winding and inverting the tape and for storing the tape in a manner that either said of the tape can be accessed.

OBJECTS OF THE INVENTION

It is a main object of the present invention to provide a device for storing the paper tape used by office machines, such as adding machines, or the like.

It is another object of the present invention to provide a device for storing the paper tape used by office machines, such as adding machines, or the like that includes a mechanism for winding and inverting the tape.

It is another object of the present invention to provide a device for storing the paper tape used by office machines, such as adding machines, or the like that includes a mechanism for winding and inverting the tape and for storing the tape in a manner that either side of the tape can be accessed.

SUMMARY OF THE INVENTION

These, and other, objects are achieved by a device which not only winds and inverts paper tape, but acts as a storage container as well. The device includes rollers which gradually invert the tape 180° in 45° increments so that the tape an be reused. The device includes a storage container that has a top foldably mounted thereon so that once the tape is printed on both sides, it can be stored in the container. The container has two twirlers and the inverting mechanism is in the container with slots and rollers on the container so the tape can be moved as necessary if reference must be made to the tape after storage.

In this manner, not only does the device permit use of both sides of the tape, but it facilitates storage as well as reference to the tape at a later time.

BRIEF DESCRIPTION OF THE DRAWING FIGURES

DETAILED DESCRIPTION OF THE PREFERRED EMBODIMENT OF THE INVENTION

Figure 1:
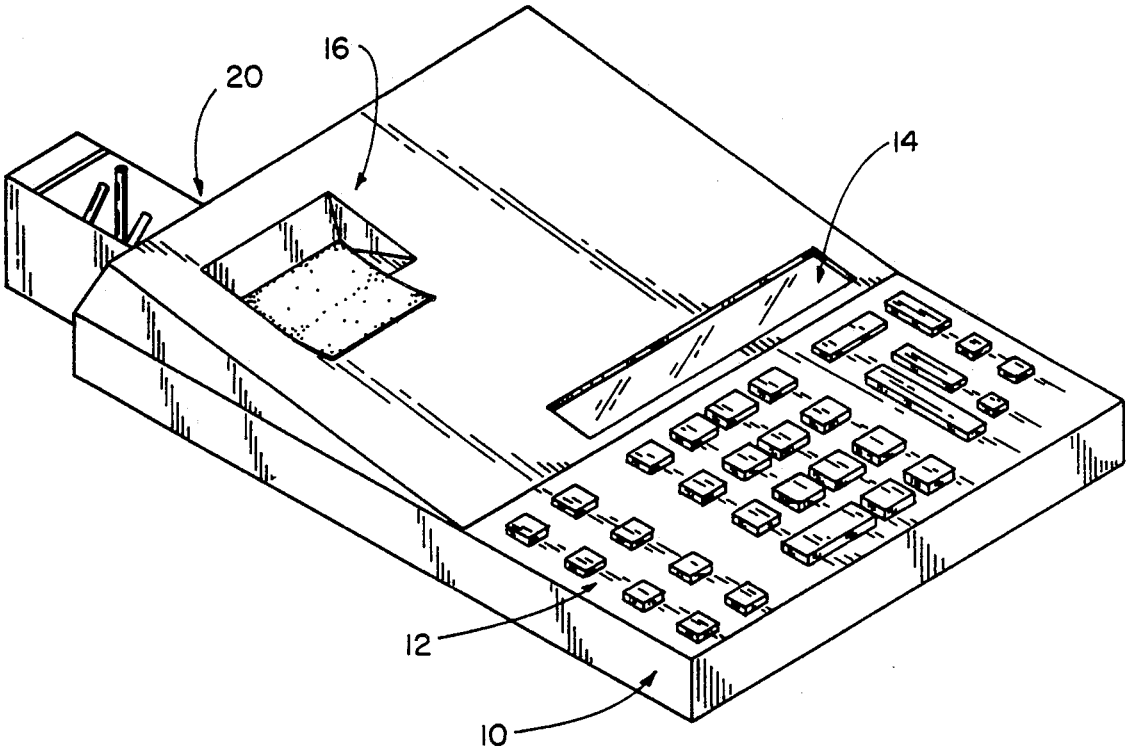
FIG. 1 is a perspective view of an office machine in conjunction with the device embodying the present invention.
Figure 5:
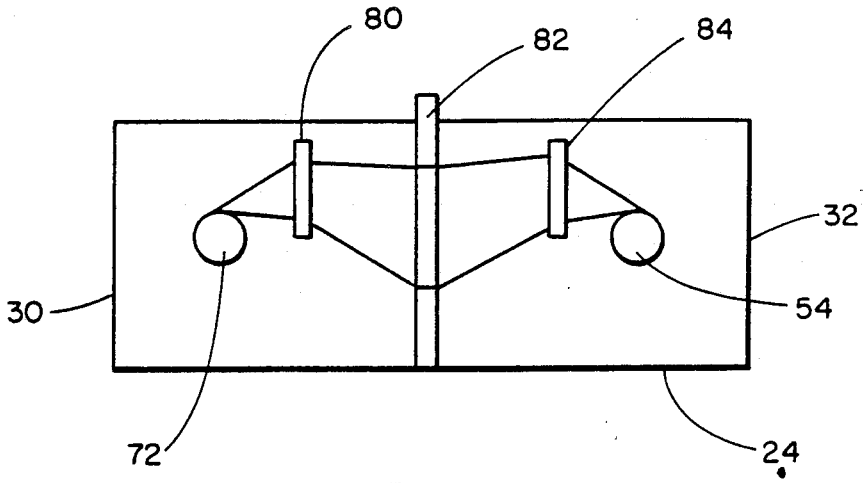
FIG. 5 is a side elevational view of the mechanism.

Shown in FIG. 1 is an office machine, such as an adding machine 10, or the like, which includes a keyboard 12 as well as viewing window 14 through which the indicia being manipulated are viewed during the operation.

The office machine also includes a paper tape assembly 16 by which a permanent record of the manipulation and tabulation is kept. The tape assembly includes the usual platen, printing mechanism, and paper delivery mechanism, and will not be discussed further, with reference being made to the art, and the skill in the art.

A device 20 embodies the present invention, and is releasably attached to the office machine adjacent to the supply and feed-out slots of the tape assembly 16 so that tape can be fed to the assembly and taken up from the assembly using the device 20. The device 20 is adapted to feed one side of the tape to the assembly and to take up printed tape from the assembly in a manner that inverts that printed tape so that a clean side of the tape is placed in position to be fed to the feed slot of the assembly when the take-up roll is substituted for the feed roll. The device 20 further includes a storage container and a means for releasably mounting such container on the office machine as well as means for closing and locking that storage container and for viewing the tape stored therein a latter time.

Figure 2:
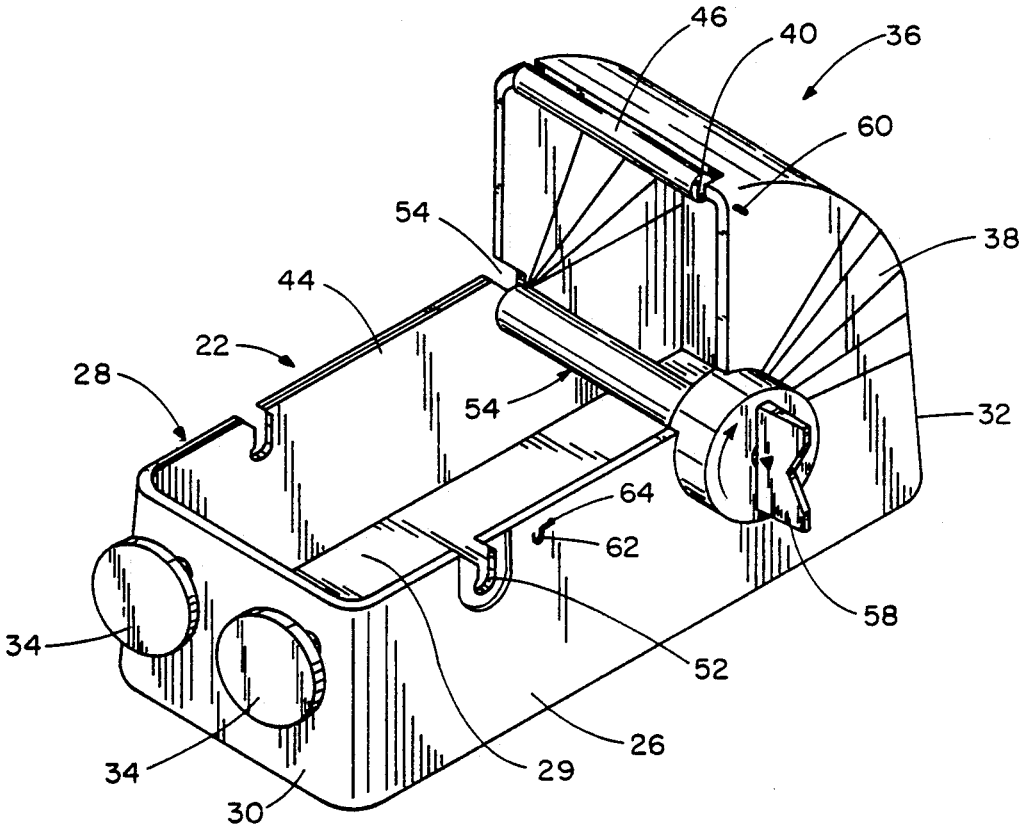
FIG. 2 is perspective view of the device of the present invention, with some of the winding and inverting mechanism omitted for the sake of clarity of showing.
Figure 3:
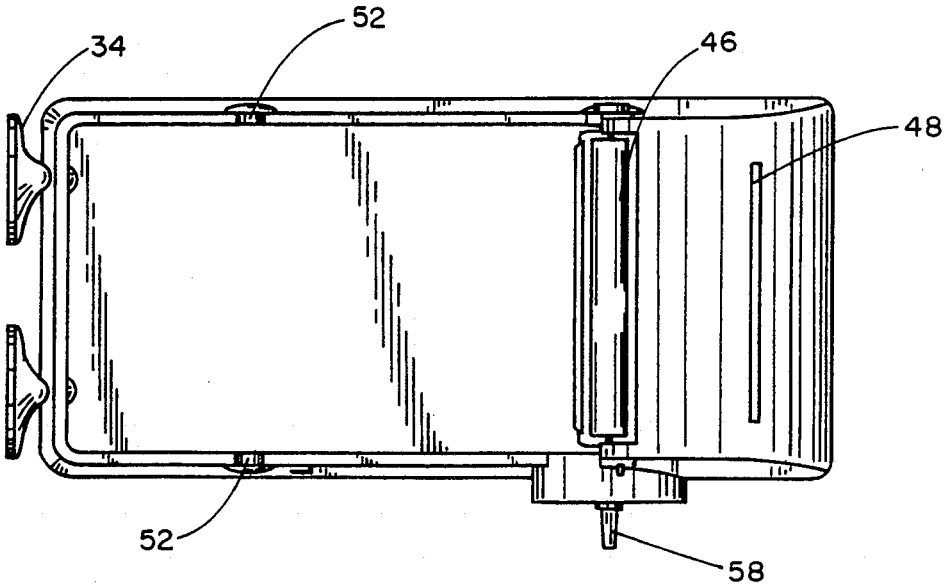
FIG. 3 is a top plan view of the device.

The device includes a container 22, best shown in FIGS. 2 and 3, and which includes a bottom wall 24, side walls 26 and 28, end walls 30 and 32, with end wall 30 being considered a proximal end wall since it has attaching means, such as suction cups 34, thereon for releasably mounting the container onto the office machine, with the end wall 32 being the distal end wall. The walls and bottom of the container cooperate to define an open-mouth container, and the container also includes a cover 36 thereon in position to close the container. The cover 36 is attached to the container side and distal end wall by a fan or accordion folded section 38 that permits the cover to move between the open position shown in FIG. 2 to a closed position with front edge 40 engaged against the top edges of the side walls, such as top edge 44. The cover is preferably sized to cover at least a portion of the container, but can also be sized to cover the entire container, with the fan folds being sized accordingly.

A paper-guiding roller 46 is mounted on the cover adjacent to the front edge 40, and a slot 48 is defined in the cover, for permitting the tape to be reviewed after both sides thereof have been used and the storage feature of the device 20 is being used, as will be understood from the ensuing discussion.

Crescent-shaped slots 50 and 52 are defined in the side walls 26 and 28 so that rollers, such as take-up roller 54 can be removably mounted on the container. A feed roller is mounted in slots 52 but is not shown in FIG. 2 for the sake of clarity. Both rollers include a twirler, such as twirler 58 so that the tape can be moved in a manual manner when desired.

The device also has a locking means mounted thereon so that the cover can be relesably locked to the rest of the container body. The locking means includes a projection 60 on the cover and a hook 62 on the side wall 26. The hook is pivotally mounted by a pivot pin 64 to rotate about that pin in the manner of a screen door hook.

Figure 4:
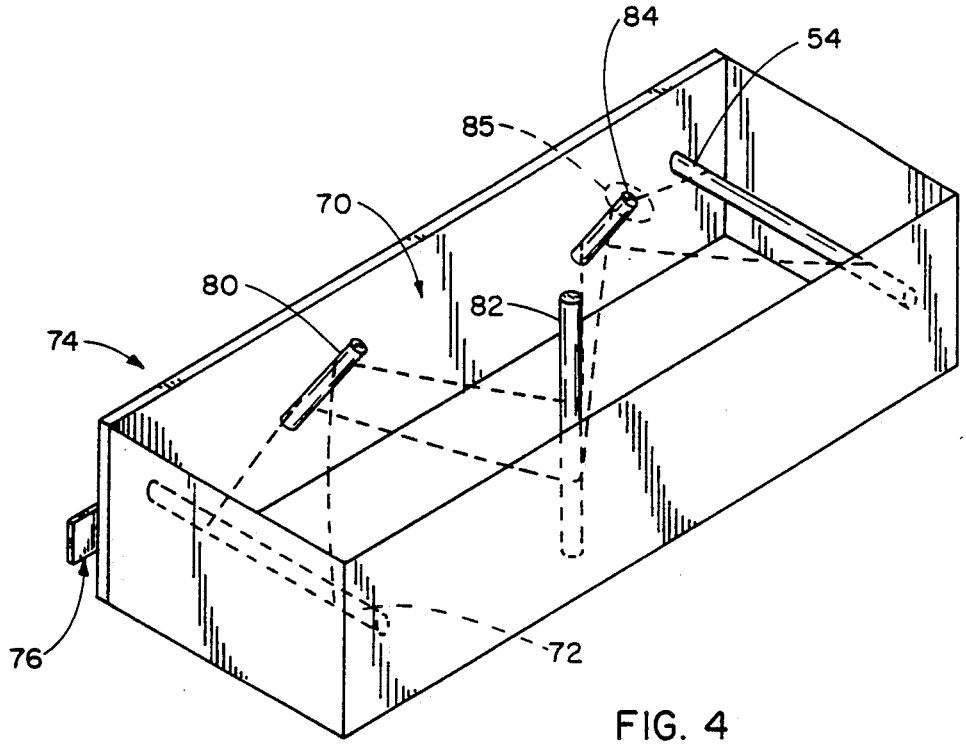
FIG. 4 is a schematic perspective view of the winding and paper-inverting mechanism of the present invention.
Figure 6:
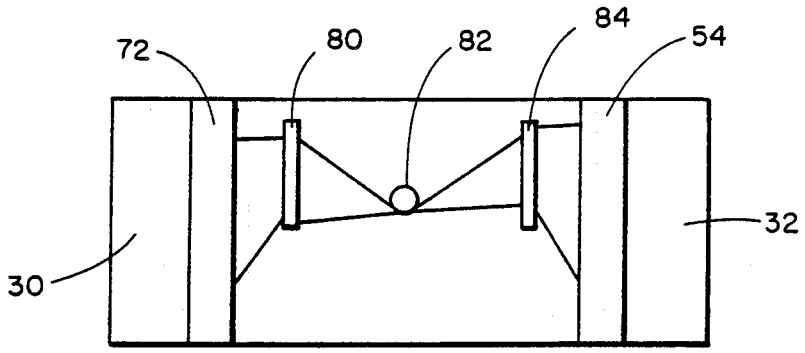
FIG. 6 is a top plan view of the mechanism.
Figure 7:
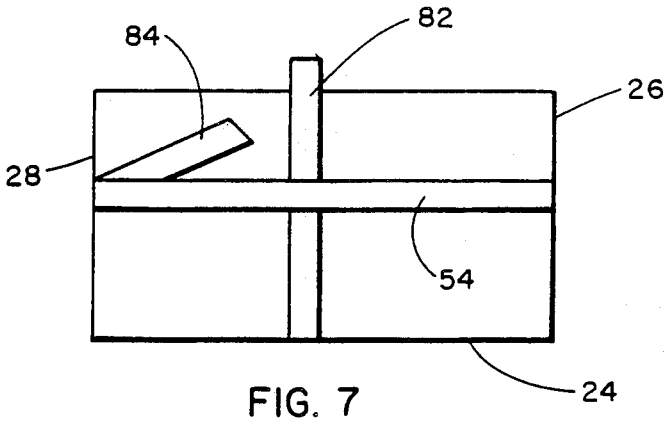
FIG. 7 is an end elevational view of the mechanism.

The device 20 includes a paper winding and inverting mechanism 70 shown in FIGS. 4, 5, 6 and 7 in a schematic manner. The mechanism 70 includes the proximal roller 72 and the distal roller 54 and a means for timing the operation of these rollers with the operation of the office machine. Such timing means is indicated in FIG. 4 by reference numeral 74, and includes an attachment element 76 that couples a timing mechanism to the operation of the office machine so that the feed and take-up rolls are rotated in co-operation with each other and in co-operation with the office machine operation. Such coupling and timing means will not be discussed, as its elements and operation will be known to those skilled in the art based on the teaching in the art, such as U.S. Pat. Nos. 4,168,038 and 4,492,345, the disclosure of which are incorporated herein by reference. A simple timing belt and pulleys can be used to couple the machine paper control to the device 20 as well as suitable gears and meshing devices to transfer such machine movement to and between the rollers of the device 20. The elements 74 and 76 can include gears that mesh with the gears of the machine and transfer such movement to and among the elements of the device 20.

The winding and inverting mechanism 70 further includes inverting rollers 80, 82 and 84 that gradually invert the paper paying off of the proximal roller 72 by 180° by the time that paper is taken up the take-up roller 54. The inverting rollers invert the paper in 45° increments, and thus include a first inverting roller 80 located adjacent to the feed roller 72 and mounted on the wall 22 at a 45° angle with respect to the feed roller 72, a second inverting roller 82 that is located adjacent to the first inverting roller and is mounted on the bottom wall to be rotated 45° with respect to the first inverting roller and thus to be rotated 90° with respect to the feed roller 72. A third inverting roller 84 is also mounted on the wall 22 between the roller 82 and the roller 54 and is oriented to be at least at a 45° angle with respect to the second roller 82 and with respect to the take-up roller 54. The third roller can be oriented at an angle which is greater than 45° if necessary to rotate the paper coming off of the roller 82 45° with respect to that roller 82 without the paper slipping off of the rollers. However, the third roller 84 extends downwardly from the wall and has a flange 85 on the lowermost end thereof for preventing papers from slipping off of the roller.

Thus, paper paying off of the feed roller in the machine 20 moves out of that machine after being imprinted and onto the feed roller 72 which, like all rollers 54, 82 and 84, can include two rollers forming a pinch opening through which the paper moves. FIG. 4 indicates the rollers 72, 54, 82 and 84 as being two-roller units; however such roller units are not shown in the other figures for the sake of clarity. The machine and/or the device will have a suitable slot, such as slot 86, to guide the paper from the machine onto the roller 72. The paper is rotated 45° from a horizontal orientation on roller 72 as that paper passes over the first inverting roller 80, and is then rotated another 45° as it passes around the second inverting roller 82 to be in a vertical orientation with respect to the horizontal orientation thereof on the feed roller 72. The paper is then fed beneath the roller 84, that is, between the roller and the wall, to be rotated another 45° as it passes around the third inverting roller 84 to be rotated a total of 135° from its horizontal orientation on the roller 72.

As the tape moves from the third roller 84 to the take-up roller 54, it rotates another 45° to be rotated a total of 180° as it passes off of the roller 72 and as it passes onto the take-up roll 54. Paper rotated 180° is inverted for the purposes of this disclosure.

Once the tape is fully taken up on the take-up roll, that roll can be substituted for the feed roll, and the above-disclosed process repeated.

Once the second side of the tape is full, the tape is ready for storage. The device 20 is removed from the office machine, and the cover folded over from the FIG. 2 orientation to a locked orientation with the front edge 40 engaging the top edge of the container side walls. The lock means can be activated if desired.

Should the tape record ever have to be reviewed, the device 20 facilitates such review. The tape is on a take-up roll, indicated in FIG. 2 by the roll 54. The free edge of the tape is fed off of the tape on the roll 54 and fed around the roll 46 after the cover is opened. The tape so fed can be fed to a take-up roll mounted on the device in the slots 52 and read as the rolls are manipulated by the twirlers 58 on the rolls.

The paper can also be fed through slot 48 either to or from the roll 54 as desired. In this manner, the paper can be fed from either roll 72 or from roll 54 as necessary. The paper being fed out of the slot or by the roll 46 elevates that paper into a position in which it is easily read, cut and spliced as required. Either side of the tape can be read in this manner.

It is understood that while certain forms of the present invention have been illustrated and described herein, it is not to be limited to the specific forms or arrangements of parts described and shown.

I claim:

1. A device for winding and inverting paper tape used on an adding machine-type office machine comprising:

a container having a bottom wall forming a bottom of said container, two side walls each having a top edge spaced from said bottom, a proximal end wall having a top edge, a distal end wall having a top edge, each of said wall top edges being spaced from said bottom wall and cooperating with each other to define a top for said container, a cover extending over said top, an accordion-folded section in said cover adjacent to said distal end wall top edge, said cover having a front edge and moving between an open position with said cover front edge spaced from said side wall top edges to a closed position with said cover front edge engaged against said side wall top edges when said accordion-folded section is collapsed and extended respectively;

suction cup attaching means on said proximal end for releasably mounting said container onto an adding machine-type office machine;

a paper winding and inverting mechanism mounted in said container and comprising a proximal roller unit extending across said container and being rotatably mounted on said container side walls near said proximal end wall, a distal roller unit extending across said container and being rotatably mounted on said container side walls near said distal end wall, said proximal and distal roller units being oriented in space relation to said bottom wall and being coplanar with each other, crescent-shaped cutouts defined in said side walls rotatably mounting said proximal and distal roller units on said side walls, said distal roller unit including a handle mounted thereon and located adjacent to one of said side walls for manually operating said distal roller unit, a first inverting roller mounted on a second side wall near said proximal roller unit and extending from said second side wall toward said container top at a 45° angle with respect to said proximal roller unit, a second inverting roller unit mounted on said bottom wall near said first inverting roller and extending at a 90° angle with respect to said proximal roller unit and being oriented vertically upward from said bottom wall, a third inverting roller unit mounted on said second side wall near said second inverting roller unit and extending from said second side wall toward said second side wall top edge at a 45° angle with respect to said second roller unit and with respect to said distal roller unit and with respect to said second side wall, said first inverting roller being located between said proximal roller unit and said second inverting roller unit, said second inverting roller unit being located between said first inverting roller and said third inverting roller unit and said third inverting roller unit being located between said second inverting roller unit and said distal roller unit, said first roller being coplanar with said third roller unit;

said proximal roller unit, said second roller unit, said third roller unit and said distal roller unit each including two roller elements located with respect to each other to define a pinch opening through which paper moves;

a paper quiding roller mounted on said cover front edge and being spaced from said cover front edge to define a paper-guiding slot with said front edge; and a latch means on said container one side wall for releasably coupling said cover to said container one side wall, said latch means including a hook pivotally attached to said one side wall, and a projection mounted on said cover near side cover front edge.

* * * * *